US005971182A

United States Patent [19]

Berge et al.

[11] Patent Number: 5,971,182

[45] Date of Patent: Oct. 26, 1999

[54] CLOSURE WITH TAMPER-EVIDENT BAND

[75] Inventors: Gary Berge, Crystal Lake; Thomas C. Stoneberg, Buffalo Grove, both of Ill.

[73] Assignee: Creative Packaging Corp., Buffalo Grove, Ill.

[21] Appl. No.: 09/080,672

[22] Filed: May 18, 1998

[51] Int. Cl.[6] ..... B65D 41/34

[52] U.S. Cl. ..... 215/252; 215/258; 215/274

[58] Field of Search ..... 215/252, 274, 215/258

[56] References Cited

U.S. PATENT DOCUMENTS

| | | | |
|---|---|---|---|
| 3,180,532 | 4/1965 | Michel . | |
| 3,817,416 | 6/1974 | Costa . | |
| 4,530,437 | 7/1985 | Gray et al. . | |
| 4,744,480 | 5/1988 | Luch et al. | 215/252 |
| 4,915,244 | 4/1990 | Celaschi et al. | 215/252 |
| 5,242,068 | 9/1993 | McCandless | 215/252 |
| 5,456,374 | 10/1995 | Beck . | |
| 5,497,906 | 3/1996 | Dubach . | |
| 5,513,763 | 5/1996 | Adams et al. . | |
| 5,588,562 | 12/1996 | Sander et al. | 215/252 |
| 5,662,231 | 9/1997 | Adams et al. . | |
| 5,829,611 | 11/1998 | Beck | 215/252 |

*Primary Examiner*—Allan N. Shoap
*Assistant Examiner*—Rodrigo L. Eichwald
*Attorney, Agent, or Firm*—Silverman, Cass & Singer, Ltd.

[57] ABSTRACT

A container cap with tamper-evident band formed with a detent ring and a tearband, forming a tamper ring. When the cap is installed on the container neck, the detent ring engages an abutment shoulder on the neck to force latch tabs formed on the detent ring to engage a tamper band formed on the cap. Detent tabs formed on the detent ring engage a tamper projection shoulder on the container neck to prevent the detent ring from removal from the container neck when the cap is removed from the container.

12 Claims, 5 Drawing Sheets

CLOSURE WITH TAMPER-EVIDENT BAND

BACKGROUND OF THE INVENTION

1. Field of the Invention

This invention relates generally to closures for re-sealable containers, and more particularly, to such closures or caps having a tamper-evident band or ring to indicate that such closures have been opened.

2. Description of the Prior Art

Tamper-evident caps commonly are provided for containers and incorporate a tamper band or ring to be engaged about the container proximate the month thereof and remain in position connected to the cap until the cap is removed from the container. When such removal is effected by a user, the tamper band or ring is permanently separated from another portion of the cap so as to provide a visual indication that the cap has been removed from the container with the possibility of unauthorized tampering with the contents thereof.

Many different constructions of caps with associated tamper-evident bands or rings are known, as shown in the prior art patents of record herein. The construction of the present invention provides such a tamper-evident ring as part of a cap which permits convenient initial installation of the cap on a container. Prior to such installation, the tamper-evident band is in an unset configuration which enables the cap to be readily so installed on the container. The tamper-evident feature of the structure of the invention is effected during installation of the cap on the container with resultant advantages during the manufacturing process of such caps.

SUMMARY OF THE INVENTION

The invention provides a tamper-evident band for a closure or container cap including a detent ring depending from the lower peripheral portion of the cap. The lower peripheral portion of the cap is attached to a tearband with a plurality of tear tabs. A plurality of detent tabs extend from the underside of the detent ring and initially are connected to the lower peripheral portion of the tearband. The tearband is formed with a tamper ring including a plurality of staggered serrations presented to the external circumferential surface of the tearband. The lower peripheral edge of the tearband initially is connected to latch tabs formed on the upper peripheral edge of the detent ring. The internal surface of the detent ring is formed with a plurality of staggered serrations for mating engagement with the serrations formed on the tamper ring. Upon initial installation of the cap on a container top, the detent ring comes in contact with an annular abutment shoulder formed on the container, stopping the detent ring and forcing its connected latch tabs to be deflected inward of the detent ring and engage under an annular tamper projection shoulder formed on the container above the abutment shoulder. Simultaneously, latch tabs of the detent ring also separate from their initial connections with the tearband edge, and the latch tabs deflect outwardly of the tearband edge as the cap is installed on the container, whereupon the respective staggered serrations of the detent ring and the tamper ring engage each other to form a tamper evident band therebetween.

Upon initial removal of the cap from the container, the serrations on the tearband remain engaged with those on the detent ring, forcing breakage of the tear tabs between the cap and ring. The detent tabs remain engaged below the annular tamper projection shoulder on the container to prevent removal of the detent ring from its position on the container.

When the cap is re-positioned on the container top, the latch tabs on the detent ring prevent the tearband from moving to its original position below the detent ring, thus providing the desired tamper-evident feature of the invention.

DESCRIPTION OF THE PREFERRED EMBODIMENT

Figure 8:
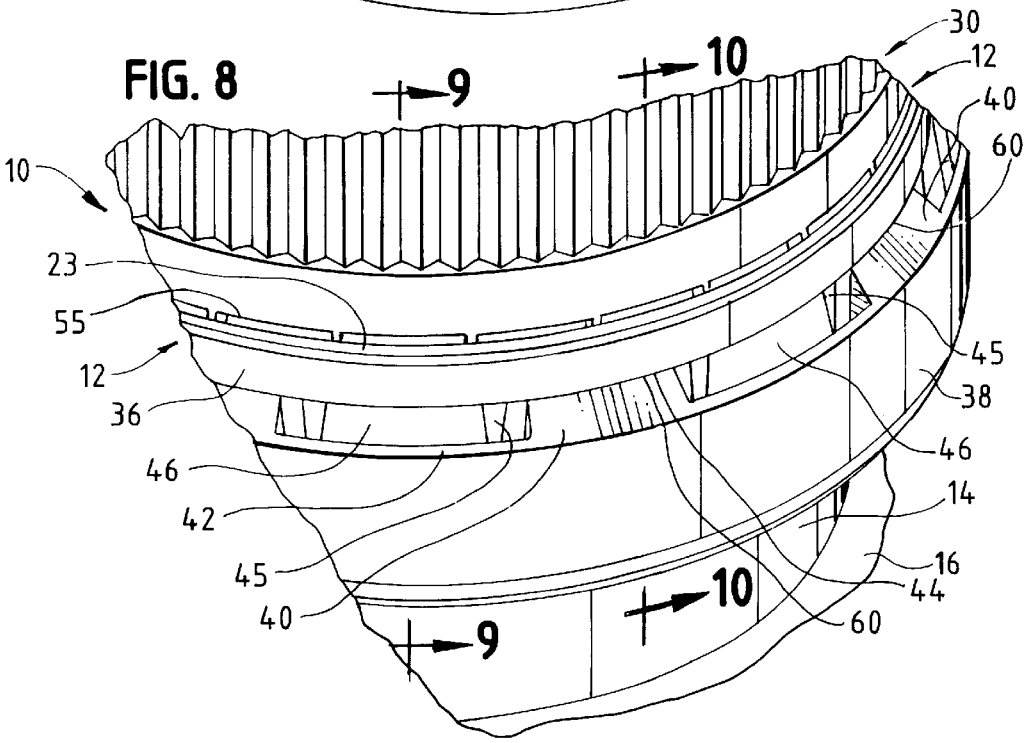
FIG. 8 is a fragmentary perspective view of a portion of the cap including the frangible tamper-evident band of the invention, the same being shown in association with a container, but prior to installation into its "set" position on the container.
Figure 9:
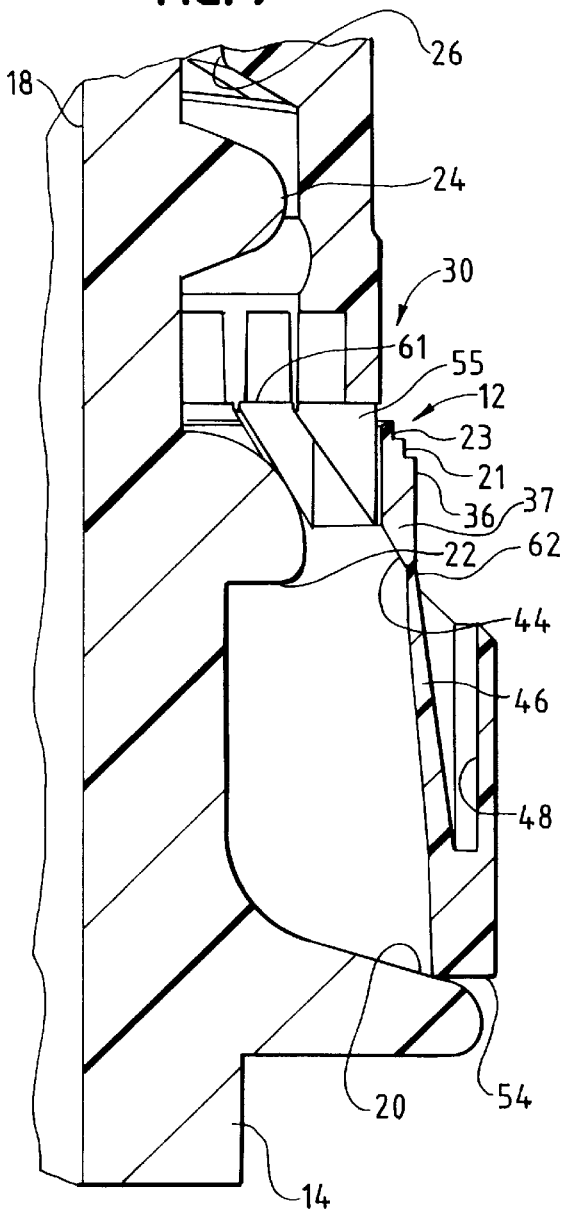
FIG. 9 is a sectional view taken along the line 9—9 of FIG. 8, in the direction indicated generally.
Figure 10:
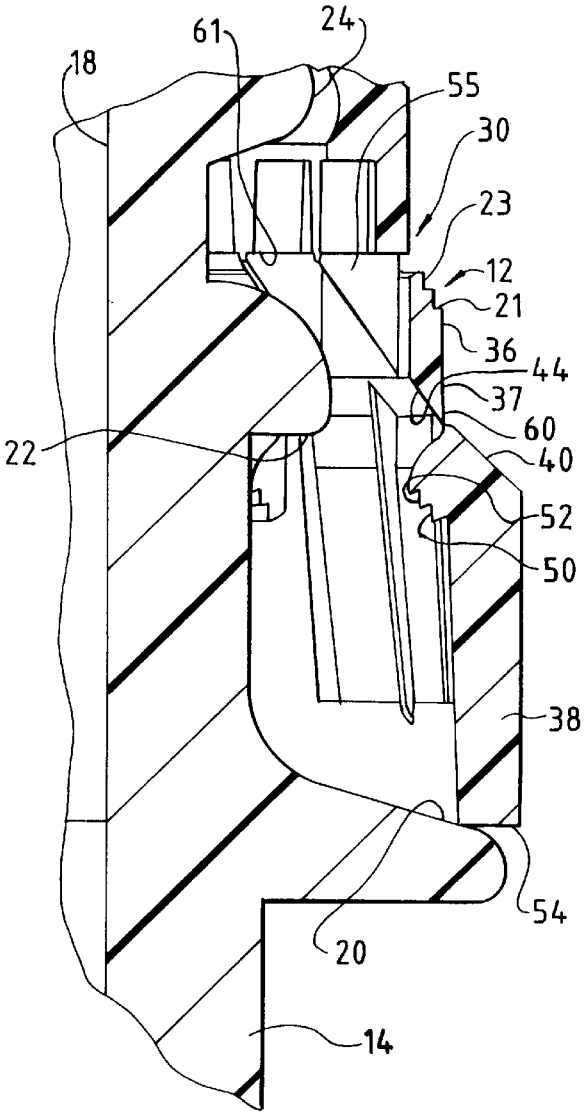
FIG. 10 is a sectional view taken along the line 10—10 of FIG. 8, in the direction indicated generally.
Figure 11:
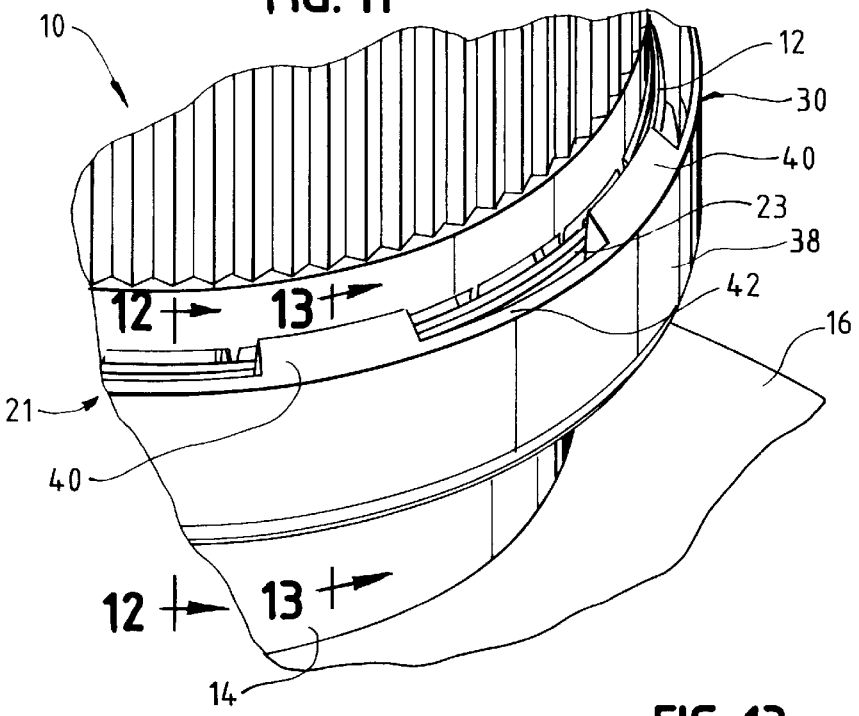
FIG. 11 is a fragmentary perspective view of a portion of the cap including the frangible tamper-evident band of the invention, the same being shown in association with a container after installation into its "set" position on the container.
Figure 12:
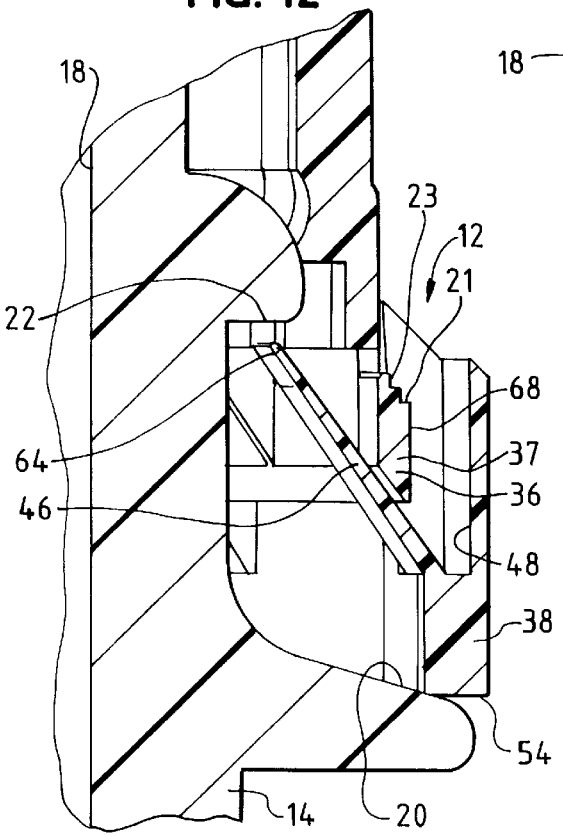
FIG. 12 is a sectional view taken along the line 12—12 of FIG. 11, in the direction indicated generally.
Figure 13:
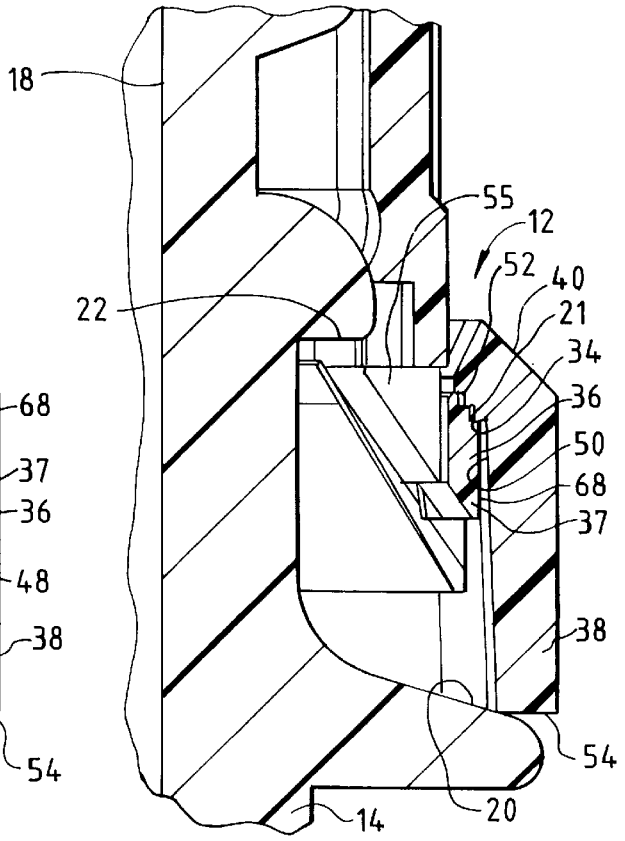
FIG. 13 is a sectional view taken along the line 13—13 of FIG. 11 in the direction indicated generally.

Referring to FIGS. 1–3 and 7, a cap 10 is shown constructed with the tamper-evident band 12 of the invention. In FIGS. 8–10, the cap 10 is shown with the tamper-evident band 12 in its configuration prior to being set on the neck 14 of a container 16 proximate to the mouth 18 thereof.

Figure 5:
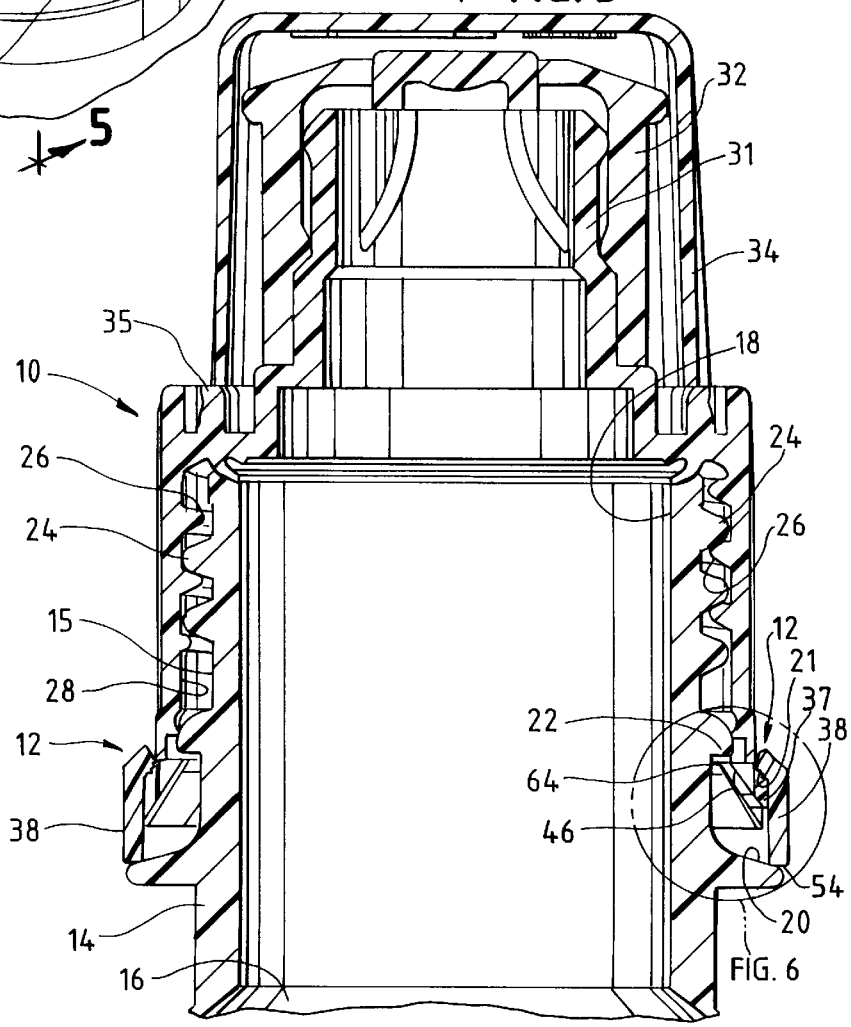
FIG. 5 is a sectional view taken along the line 5—5 of FIG. 4, in the direction indicated generally.
Figure 7:
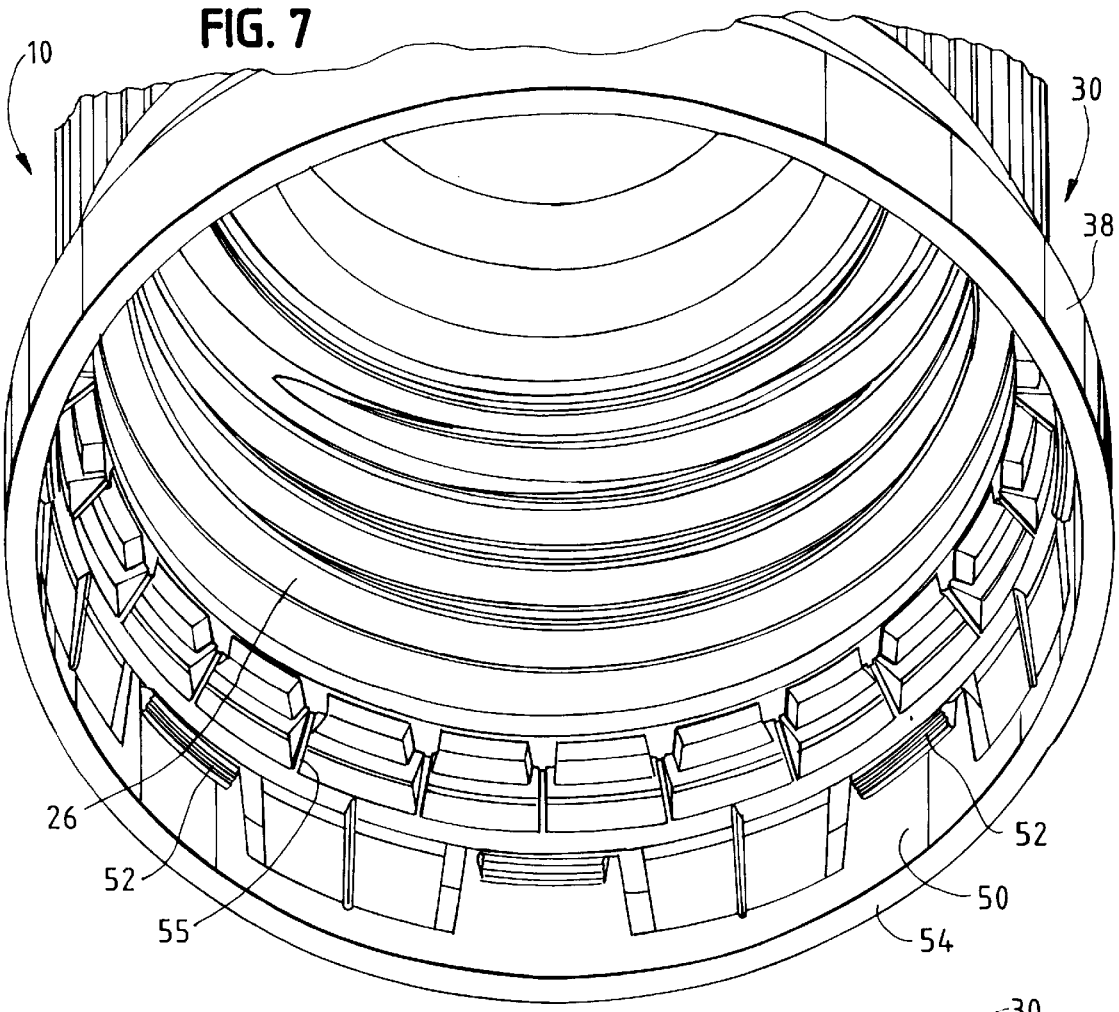
FIG. 7 is a perspective view of the underside of the container cap including the frangible tamper-evident band of the invention.

Neck 14 of container 16 is formed with an annular abutment shoulder 20 and an annular tamper projection shoulder 22 spaced above shoulder 20. Neck 14 also has formed on the external surface 15 thereof (see FIG. 5) screw threads 24 for mating engagement with threads 26 formed on the inner circumferential surface 28 of cap 10. Thus, cap 10 is adapted for installation on container 16 by screwing same on neck 14 in known manner.

Cap 10 includes a post 31 with associated spout 32 and overcap 34 formed thereabove extending from base 35. Spout 32 and associated elements permits removal of the contents of container 16 in known manner if it is desired to do so without disengagement of cap 10 from neck 14. The construction and operation of the post, spout and overcap is known and disclosed, for example, in co-pending U.S.

application Ser. No. 08/726,511, filed Oct. 7, 1996, now U.S. Pat. No. 5,829,611, entitled "Tamper Evident Overcap," the disclosure of which hereby is incorporated herein by reference.

The lower peripheral portion 30 of cap 10 has the tamper-evident band 12 of the invention formed thereon. An annular tearband 36 having a plurality of stepped or staggered serrations 23 is formed on the lower peripheral portion 30 of cap 10. The serrations 23 are presented to the external surface 37 of portion 30 (see FIGS. 9–10). The tearband 36 forms a tamper ring 21 extending about the entire circumferential surface thereof.

An annular detent ring 38 is positioned circumferentially about the cap 10 and is formed with a plurality of latch tabs 40 extending between the upper peripheral edge 42 of the detent ring and the lower peripheral edge 44 of the tearband 36 (see FIG. 8). A plurality of detent tabs 46 extend from the underside or inner facing surface 48 of the detent ring 38 and initially also are frangibly connected to the lower peripheral edge 44 of tearband 36. The position or locations of the respective connections of the latch tabs 40 and detent tabs 46 to the edge 44 of tearband 36 are alternated in spaced relationship about the circumference of the tearband 36, with spaces 45 therebetween (see FIG. 8).

The internal surface 50 of detent ring 38 is formed with a plurality of stepped or staggered serrations 52. Serrations 52 are dimensioned and arranged about the circumferential interior surface 50 of detent ring 38 for mating engagement with serrations 23 formed on tearband 36.

Cap 10 in installed upon container 16 by positioning the cap over container neck 14 so that the lower peripheral edge 54 of detent ring 38 comes in contact with annular abutment shoulder 20 of the container. Detent ring 38 is then forced against shoulder 20 by screwing cap threads 26 on container threads 24. Alternatively, the cap 10 could be pushed downwardly on neck 14 by an external force so that detent ring 38 engages shoulder 20. In such instance, cap 10 and neck 14 could be formed with or without mating screw threads.

As the cap 10 is engaged upon neck 14, detent ring and connected latch tabs 40 are forced to move outward as detent ring edge 54 contacts shoulder 20. Simultaneously during such movement, latch tabs 40 break and separate from edge 44 of tearband 36 at points 60, and detent tabs 46 break and separate from edge 44 of tearband 36 at points 62 (see FIG. 9). The detent tabs 46 are deflected radially inward of detent ring 38 and the separated terminal ends 64 thereof are forced to engage under annular tamper projection shoulder 22 formed on neck 14 above shoulder 20 (see FIG. 12). The latch tabs 40 are deflected radially outward with respect to detent ring 38 and the external peripheral surface 68 of tearband 36 and, as the cap is continued to be screwed on neck 14, respective staggered serrations 34 and 52 engage each other to form the tamper evident band 12 therebetween (see FIG. 13). In this position, cap 10 is "set" on container 16 and removably "locked" in position thereon with tamper-evident band 12 in place, as shown in FIGS. 4–6 and 11–13.

Figure 1:
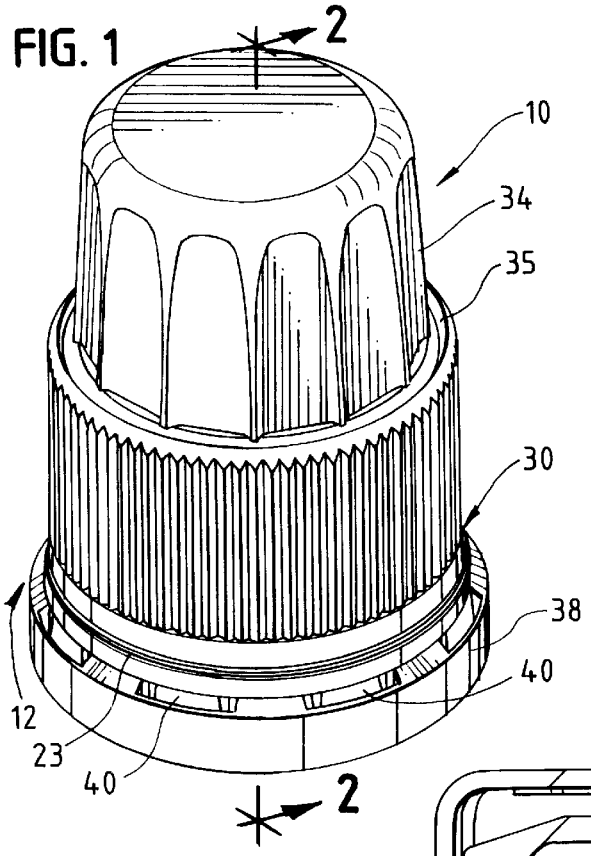
FIG. 1 is a perspective view of a container cap including the frangible tamper-evident band of the invention, the same being shown prior to installation on a container.
Figure 3:
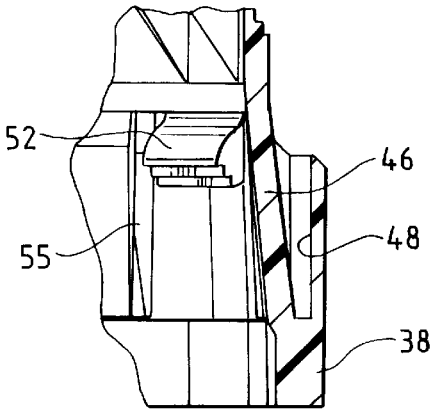
FIG. 3 is an enlarged sectional view taken through the circular section indicated as "FIG. 3" in FIG. 2.
Figure 2:
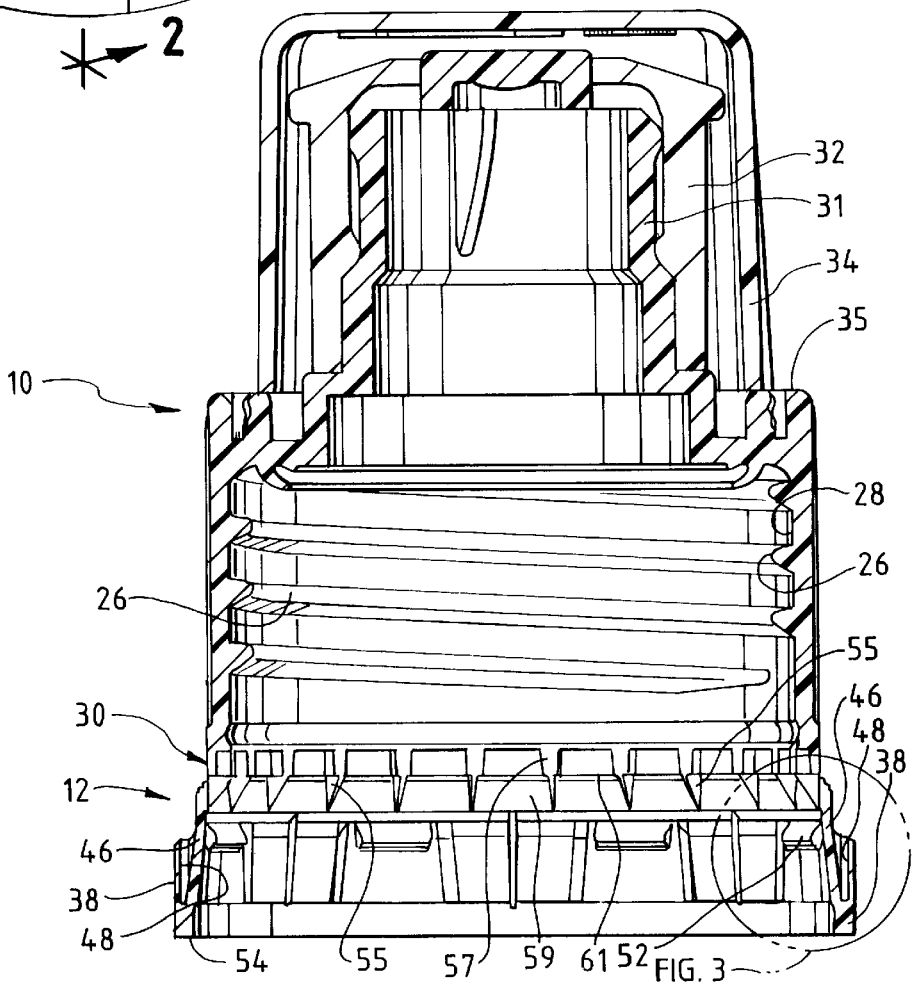
FIG. 2 is a sectional view taken along the line 2—2 of FIG. 1, in the direction indicated generally.
Figure 4:
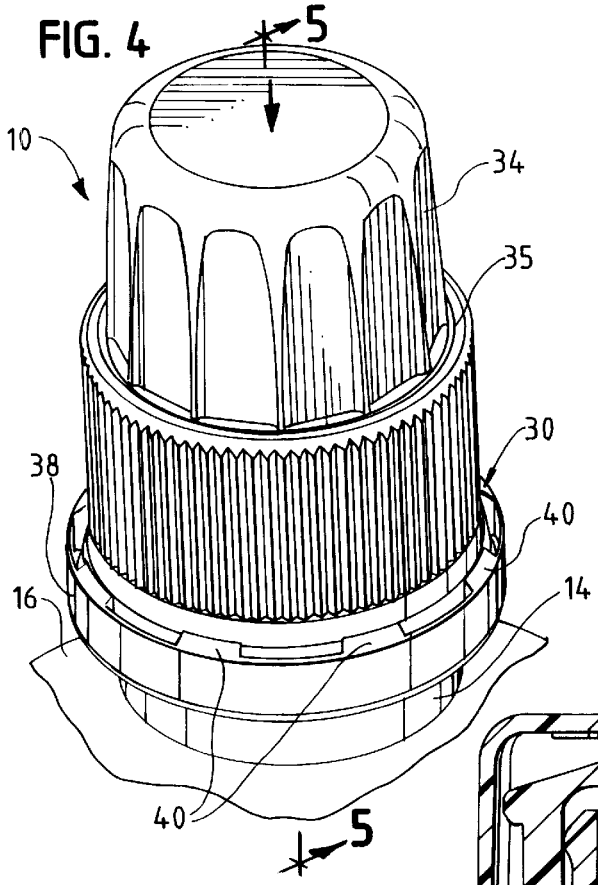
FIG. 4 is a perspective view of a container cap including the frangible tamper-evident band of the invention, the same being shown installed on a container.
Figure 6:
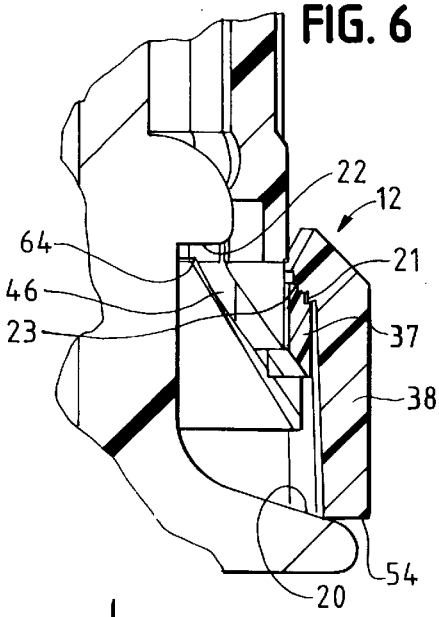
FIG. 6 is an enlarged sectional view taken through the circular section indicated as "FIG. 6" in FIG. 5.

A plurality of frangible teartabs 55 is positioned about the inner circumference 57 of lower portion 30 of cap 10 (see FIG. 2). The teartabs 55 are connected between the lower portion 30 and the inner circumference 59 of tearband 36.

Upon initial removal of cap 10 from container 16, such as by unscrewing the cap from neck 14, the teartabs 55 are broken along their joinder line 61 with lower portion 30 by reason of the removal force exerted when the cap is unscrewed. The detent tabs 46 and serrations 23 remain engaged below the annular projection shoulder 22 to prevent removal of the detent ring 38 from its position on the neck 14 of the container. When cap 10 is repositioned on container 16, the teartabs 55 are noticeably broken, thus providing the desired tamper-evident feature of the invention.

The invention provides several advantages over the prior art. The staggered serrations 34, 52 allow for tolerance variations between parts, providing a proper fit of the cap to the container. Tear tab breakage starts immediately when the cap is attempted to be removed. Prior art caps can be rotated considerably before any engagement of the detents allowing for the seal to be broken prior to any tear tab breakage.

The cap of the invention may be molded with full threads, and is not stripped, thus allowing for a better fit of the cap to container. There is no interference of the cap with the container prior to thread engagement, allowing for usage of standard capping equipment.

Minor variations in the structure and other variations in the arrangement and size of the various parts may occur to those skilled in the art without departing from the spirit or circumventing the scope of the invention as set forth in the appended claims.

We claim:

1. A tamper-evident closure comprising, a cap for a container, the container including a neck with an annular abutment shoulder and an annular tamper projection shoulder spaced above the abutment shoulder, the cap having a lower peripheral portion with a tearband formed thereon, the tearband including a plurality of staggered serrations presented to the external surface of the cap, an annular detent ring positioned circumferentially about the lower peripheral portion, said detent ring including a plurality of latch tabs extending from an upper peripheral edge thereof, said latch tabs being connected to said tearband at respective break points along said tearband, a plurality of detent tabs extending from an inner facing surface of said detent ring and frangibly connected to said tearband, said inner facing surface of said detent ring including a plurality of staggered serrations dimensioned and arranged for mating engagement with the serrations on said tearband, whereby upon installation of the cap on the container, the detent ring engages the abutment shoulder to cause the latch tabs to separate from the tearband at said break points and the serrations on the detent ring engage the serrations on the tearband.

2. A tamper-evident closure as claimed in claim 1 in which the tearband has a lower peripheral edge, and said latch tabs extend between said detent ring and the lower peripheral edge of the tearband.

3. A tamper-evident closure as claimed in claim 2 in which the locations of the respective connections of the latch tabs and the detent tabs to the tearband are alternated in spaced relationship.

4. A tamper-evident closure as claimed in claim 2 in which the detent tabs separate from said tearband and are deflected inwardly of the detent ring as the cap is installed on the container.

5. A tamper-evident closure as claimed in claim 4 in which said separated detent tabs have terminal ends which are forced to engage under said annular tamper projection shoulder when said cap is installed on the container.

6. A tamper-evident closure as claimed in claim 5 in which said latch tabs are deflected radially outwardly with respect to the detent ring as the cap is installed on the container.

7. In combination, a tamper-evident closure and a container for receipt of the closure thereon, said container including a neck with an annular abutment shoulder and an annular tamper projection shoulder spaced above the abutment shoulder, said closure comprising, a cap, the cap having a lower peripheral portion with a tearband formed thereon, the tearband including a plurality of staggered serrations presented to the external surface of the cap, an annular detent ring positioned circumferentially about the lower peripheral portion, said detent ring including a plurality of latch tabs extending from an upper peripheral edge thereof, said latch tabs being connected to said tearband at respective break points along said tearband, a plurality of detent tabs extending from an inner facing surface of said detent ring and frangibly connected to said tearband, said inner facing surface of said detent ring including a plurality of staggered serrations dimensioned and arranged for mating engagement with the serrations on said tearband, whereby upon installation of the cap on the container, the detent ring engages the abutment shoulder to cause the latch tabs to separate from the tearband at said break points and the serrations on the detent ring engage the serrations on the tearband.

8. The combination as claimed in claim 7 in which the tearband has a lower peripheral edge, and said latch tabs extend between said detent ring and the lower peripheral edge of the tearband.

9. The combination as claimed in claim 8 in which the locations of the respective connections of the latch tabs and the detent tabs to the tearband are alternated in spaced relationship.

10. The combination as claimed in claim 8 in which the detent tabs separate from said tearband and are deflected inwardly of the detent ring as the cap is installed on the container.

11. The combination as claimed in claim 10 in which said separated detent tabs have terminal ends which are forced to engage under said annular tamper projection shoulder when said cap is installed on the container.

12. The combination as claimed in claim 11 in which said latch tabs are deflected radially outwardly with respect to the detent ring as the cap is installed on the container.

* * * * *